US009567843B2

(12) United States Patent
Saeed et al.

(10) Patent No.: US 9,567,843 B2
(45) Date of Patent: Feb. 14, 2017

(54) WELL DRILLING METHODS WITH EVENT DETECTION

(75) Inventors: Saad Saeed, Houston, TX (US); Charles M. Pool, Bedford, TX (US); Frank Urias, Plano, TX (US); James R. Lovorn, Tomball, TX (US); Emad Bakri, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1301 days.

(21) Appl. No.: 12/831,716

(22) Filed: Jul. 7, 2010

(65) Prior Publication Data

US 2011/0024189 A1 Feb. 3, 2011

(51) Int. Cl.
*E21B 47/00* (2012.01)
*E21B 44/00* (2006.01)
(Continued)

(52) U.S. Cl.
CPC ..... *E21B 44/00* (2013.01); *E21B 21/08* (2013.01); *E21B 2021/006* (2013.01)

(58) Field of Classification Search
CPC .... E21B 44/00; E21B 21/08; E21B 2021/006; E21B 21/10; E21B 47/00
(Continued)

(56) References Cited

U.S. PATENT DOCUMENTS 2,223,397 A 12/1940 White et al.
3,603,409 A 9/1971 Watkins
(Continued)

FOREIGN PATENT DOCUMENTS

EP 1356186 B1 6/2005
EP 1907664 A1 4/2008
(Continued)

OTHER PUBLICATIONS

International Search Report and Written Opinion issued Sep. 29, 2009, for International Patent Application Serial No. PCT/US09/052227, 8 pages.
(Continued)

*Primary Examiner* — Nicole Coy
(74) *Attorney, Agent, or Firm* — Chamberlain Hrdlicka

(57) ABSTRACT

A drilling method includes assigning values to behaviors of drilling parameters during a drilling operation; forming multiple parameter signatures, each of the parameter signatures comprising a respective combination of the values; comparing the parameter signatures to multiple event signatures, each of the event signatures being indicative of a respective drilling event; and controlling the drilling operation in response to at least a partial match resulting from comparing the parameter signatures to the event signatures. Another method includes defining an event signature comprising a unique combination of a behavior of each of multiple drilling parameters, the event signature being indicative of a drilling event; accessing data from each of multiple sensors which sense the respective drilling parameters during a drilling operation; determining multiple parameter signature segments from the respective sensed drilling parameters; combining the parameter signature segments, thereby forming a parameter signature; and comparing the parameter signature to the event signature.

44 Claims, 5 Drawing Sheets

(51) Int. Cl.
*E21B 21/08* (2006.01)
*E21B 21/00* (2006.01)

(58) Field of Classification Search
USPC ..... 175/24, 25, 40, 57; 700/28; 702/1, 127, 702/182, 183, 187, 189
See application file for complete search history.

(56) References Cited

U.S. PATENT DOCUMENTS

| | | | | |
|---|---|---|---|---|
| 4,046,191 | A | 9/1977 | Neath | |
| 4,063,602 | A | 12/1977 | Howell et al. | |
| 4,099,583 | A | 7/1978 | Maus | |
| 4,188,624 | A | 2/1980 | Hochsprung et al. | |
| 4,194,567 | A | 3/1980 | Marais | |
| 4,275,788 | A | 6/1981 | Sweatman | |
| 4,291,772 | A | 9/1981 | Beynet | |
| 4,355,784 | A | 10/1982 | Cain | |
| 4,387,770 | A | 6/1983 | Hill | |
| 4,606,415 | A | 8/1986 | Gray, Jr. et al. | |
| 4,627,496 | A | 12/1986 | Ashford et al. | |
| 4,819,727 | A | 4/1989 | Jennings, Jr. | |
| 4,880,060 | A | 11/1989 | Schwendemann et al. | |
| 5,006,845 | A | 4/1991 | Calcar et al. | |
| 5,327,973 | A | 7/1994 | Jennings, Jr. | |
| 5,465,798 | A | 11/1995 | Edlund et al. | |
| 5,529,128 | A | 6/1996 | Peterson et al. | |
| 5,771,974 | A | 6/1998 | Stewart et al. | |
| 5,839,090 | A | 11/1998 | Zoraster | |
| 5,842,149 | A | 11/1998 | Harrell et al. | |
| 6,145,591 | A | 11/2000 | Boncan et al. | |
| 6,152,246 | A * | 11/2000 | King et al. | 175/26 |
| 6,173,768 | B1 | 1/2001 | Watson | |
| 6,206,108 | B1 | 3/2001 | MacDonald et al. | |
| 6,208,586 | B1 | 3/2001 | Rorden et al. | |
| 6,230,824 | B1 | 5/2001 | Peterman et al. | |
| 6,418,381 | B1 | 7/2002 | Fuller | |
| 6,484,816 | B1 | 11/2002 | Koederitz | |
| 6,662,110 | B1 | 12/2003 | Bargach et al. | |
| 6,668,943 | B1 | 12/2003 | Maus et al. | |
| 6,814,140 | B2 | 11/2004 | Robichaux | |
| 6,820,702 | B2 | 11/2004 | Niedermayr et al. | |
| 6,854,532 | B2 | 2/2005 | Fincher et al. | |
| 6,868,920 | B2 | 3/2005 | Hoteit et al. | |
| 6,892,812 | B2 | 5/2005 | Niedermayr et al. | |
| 6,896,055 | B2 | 5/2005 | Koithan | |
| 6,944,547 | B2 | 9/2005 | Womer et al. | |
| 7,044,237 | B2 | 5/2006 | Leuchtenberg | |
| 7,090,036 | B2 | 8/2006 | DeBoer | |
| 7,114,571 | B2 | 10/2006 | Gatherar et al. | |
| 7,128,167 | B2 | 10/2006 | Dunlop et al. | |
| 7,201,231 | B2 | 4/2007 | Chaplin et al. | |
| 7,207,399 | B2 | 4/2007 | Duhe et al. | |
| 7,237,613 | B2 | 7/2007 | Radi et al. | |
| 7,237,623 | B2 | 7/2007 | Hannegan | |
| 7,270,185 | B2 | 9/2007 | Fontana et al. | |
| 7,281,593 | B2 | 10/2007 | Steiner et al. | |
| 7,526,930 | B2 | 5/2009 | Guidry et al. | |
| 7,762,329 | B1 | 7/2010 | Morgan et al. | |
| 7,913,774 | B2 | 3/2011 | Partouche | |
| 7,926,593 | B2 | 4/2011 | Bailey et al. | |
| 8,033,335 | B2 | 10/2011 | Orbell et al. | |
| 2002/0092655 | A1 | 7/2002 | Fincher et al. | |
| 2002/0108783 | A1 | 8/2002 | Elkins et al. | |
| 2003/0066650 | A1 | 4/2003 | Fontana et al. | |
| 2003/0098181 | A1 | 5/2003 | Aronstam et al. | |
| 2003/0127230 | A1 | 7/2003 | Von Eberstein, Jr. et al. | |
| 2003/0139916 | A1 | 7/2003 | Choe et al. | |
| 2003/0220742 | A1 | 11/2003 | Niedermayr et al. | |
| 2003/0234120 | A1 | 12/2003 | Paluch et al. | |
| 2004/0010746 | A1 | 1/2004 | Lucas et al. | |
| 2004/0019427 | A1 | 1/2004 | San Martin et al. | |
| 2004/0040746 | A1 | 3/2004 | Niedermayr et al. | |
| 2004/0124008 | A1 | 7/2004 | Fincher et al. | |
| 2005/0092523 | A1 | 5/2005 | McCaskill et al. | |
| 2005/0098349 | A1 | 5/2005 | Krueger et al. | |
| 2005/0241835 | A1 | 11/2005 | Burris, II et al. | |
| 2005/0269083 | A1 | 12/2005 | Burris, II et al. | |
| 2006/0006004 | A1 | 1/2006 | Terry et al. | |
| 2006/0207795 | A1 | 9/2006 | Kinder et al. | |
| 2007/0168056 | A1 | 7/2007 | Shayegi et al. | |
| 2008/0041149 | A1 | 2/2008 | Leuchtenberg | |
| 2008/0060846 | A1 | 3/2008 | Belcher et al. | |
| 2008/0105434 | A1 | 5/2008 | Orbell et al. | |
| 2008/0128130 | A1 | 6/2008 | Whitsitt et al. | |
| 2008/0228680 | A1 | 9/2008 | Chen et al. | |
| 2008/0234939 | A1 | 9/2008 | Foot et al. | |
| 2008/0262737 | A1 | 10/2008 | Thigpen et al. | |
| 2009/0159334 | A1 | 6/2009 | Alberty | |
| 2009/0192731 | A1 | 7/2009 | De Jesus et al. | |
| 2009/0200014 | A1 | 8/2009 | Schottle et al. | |
| 2010/0018715 | A1 | 1/2010 | Orbell et al. | |
| 2011/0024189 | A1 | 2/2011 | Saeed et al. | |
| 2011/0139506 | A1 | 6/2011 | Lovorn et al. | |
| 2011/0139509 | A1 | 6/2011 | Pool et al. | |
| 2011/0290562 | A1 | 12/2011 | Standifird et al. | |
| 2012/0165997 | A1 | 6/2012 | Lewis et al. | |
| 2012/0168171 | A1 | 7/2012 | Varpe | |
| 2012/0242920 | A1 | 9/2012 | Xu et al. | |
| 2012/0251407 | A1 | 10/2012 | Petela et al. | |
| 2012/0255776 | A1 | 10/2012 | Knudsen et al. | |
| 2012/0255777 | A1 | 10/2012 | Bernard | |
| 2012/0277918 | A1 | 11/2012 | Pool et al. | |

FOREIGN PATENT DOCUMENTS

| | | | |
|---|---|---|---|
| EP | 1917444 | A1 | 5/2008 |
| EP | 1936112 | A2 | 6/2008 |
| EP | 1969204 | A2 | 9/2008 |
| EP | 2150681 | A1 | 2/2010 |
| EP | 2171207 | A1 | 4/2010 |
| EP | 2179127 | A1 | 4/2010 |
| EP | 2231997 | A2 | 9/2010 |
| GB | 2229787 | A | 10/1990 |
| GB | 2398091 | A | 8/2004 |
| WO | 9942696 | A1 | 8/1999 |
| WO | 0183941 | A1 | 11/2001 |
| WO | 0190528 | A1 | 11/2001 |
| WO | 0244518 | A1 | 6/2002 |
| WO | 03025334 | A8 | 3/2003 |
| WO | 03025336 | A1 | 3/2003 |
| WO | 03058545 | A1 | 7/2003 |
| WO | 03064812 | A1 | 8/2003 |
| WO | 03071091 | A9 | 8/2003 |
| WO | 2004005667 | A1 | 1/2004 |
| WO | 2004074627 | A1 | 9/2004 |
| WO | 2004085788 | A3 | 10/2004 |
| WO | 2005001237 | A1 | 1/2005 |
| WO | 2005017308 | A1 | 2/2005 |
| WO | 2006029379 | A1 | 3/2006 |
| WO | 2006031119 | A1 | 3/2006 |
| WO | 2006099362 | A1 | 9/2006 |
| WO | 2006118920 | A3 | 11/2006 |
| WO | 2006138565 | A1 | 12/2006 |
| WO | 2007008085 | A1 | 1/2007 |
| WO | 2007016000 | A1 | 2/2007 |
| WO | 2007030017 | A1 | 3/2007 |
| WO | 2007081711 | A3 | 7/2007 |
| WO | 2007112291 | A3 | 10/2007 |
| WO | 2007112292 | A3 | 10/2007 |
| WO | 2007124330 | A3 | 11/2007 |
| WO | 2007126833 | A1 | 11/2007 |
| WO | 2007136378 | A1 | 11/2007 |
| WO | 2008133523 | A1 | 11/2008 |
| WO | 2008134266 | A1 | 11/2008 |
| WO | 2008151128 | A9 | 12/2008 |
| WO | 2008156376 | A1 | 12/2008 |
| WO | 2009017418 | A1 | 2/2009 |
| WO | 2009018448 | A2 | 2/2009 |
| WO | 2009058706 | A2 | 5/2009 |
| WO | 2009086442 | A3 | 7/2009 |
| WO | 2009111412 | A2 | 9/2009 |
| WO | 2009123476 | A1 | 10/2009 |
| WO | 2010065646 | A3 | 6/2010 |

(56) References Cited

FOREIGN PATENT DOCUMENTS

| | | | |
|---|---|---|---|
| WO | 2010071656 | A1 | 6/2010 |
| WO | 2010095947 | A1 | 8/2010 |
| WO | 2011043764 | A1 | 4/2011 |

OTHER PUBLICATIONS

Sperry-Sun Drilling Services, Early Warning System, undated, 9 pages.
International Search Report with Written Opinion issued Oct. 13, 2010 for PCT Patent Application No. PCT/US10/020122, 13 pages.
International Search Report with Written Opinion issued Jun. 17, 2011 for PCT Patent Application No. PCT/US10/056433, 9 pages.
International Search Report with Written Opinion issued Dec. 21, 2011 for PCT Patent Application No. PCT/US11/031790, 15 pages.
International Search Report with Written Opinion issued Feb. 17, 2012 for PCT Patent Application No. PCT/US11/043750, 11 pages.
MI Swaco; "10k Super AutoChoke", product bulletin MS-04104, dated Aug. 2004, 4 pages.
IADC Well Control Europe; "Well Control in an Increasingly Complex and Changing Environment", Conference and Exhibition 2010, dated Apr. 13-14, 2010, 4 pages.
Patent Application and drawings, filed Feb. 28, 2012, for U.S. Appl. No. 13/392,900, 34 pages.
Patent application and drawings, filed Mar. 19, 2012, U.S. Appl. No. 13/423,366, 29 pages.
Pre-Interview First Office Action issued Jul. 14, 2010 for U.S. Appl. No. 11/936,411, 14 pages.
Australian Office Action issued Oct. 5, 2010 for AU Patent Application No. 2007317276, 2 pages.
International Search Report with Written Opinion issued Jan. 25, 2011 for PCT Patent Application No. PCT/US10/032578, 9 pages.
Office Action issued Sep. 16, 2011 for U.S. Appl. No. 12/299,411, 23 pages.
International Search Report with Written Opinion issued Nov. 21, 2011 for PCT Patent Application No. PCT/US11/036616, 13 pages.
Office Action issued Nov. 25, 2011 for U.S. Appl. No. 13/084,841, 19 pages.
International Search Report with Written Opinion issued Dec. 13, 2011 for PCT Patent Application No. PCT/US11/035751, 16 pages.
Specification and Drawings for U.S. Appl. No. 13/491,513, filed Jun. 7, 2012, 59 pages.
Singapore Examination Report issued Dec. 27, 2011 for SG Patent Application No. 200903022-2, 8 pages.
Office Action issued Feb. 7, 2012 for U.S. Appl. No. 13/022,964, 15 pages.
International Search Report with Written Opinion issued Feb. 8, 2012 for PCT Patent Application No. PCT/US11/031767, 9 pages.
International Preliminary Report on Patentability issued Feb. 9, 2012 for PCT Patent Application No. PCT/US09/052227, 7 pages.
Written Opinion issued May 13, 2010 for SG Patent Application Serial No. 2009030222, 10 pages.
Office Action issued Jan. 20, 2011 for Canadian Patent Application No. 2,668,152, 2 pages.
Written Opinion issued Feb. 15, 2011 for SG Patent Application Serial No. 200903022-2, 9 pages.
Office Action issued Mar. 7, 2011 for Australian Patent Application No. 2007317276, 2 pages.
English Translation of Office Action issued Feb. 22, 2012 for Chinese Patent Application 200780049409.0, 7 pages.
IRIS; "Automatic Coordination of Equipment While Circulating out a Kick and Displacing the Kill-Weight Mud," IADC Well Control Europe, dated 2010, 41 pages.
Office Action issued Mar. 14, 2012 for U.S. Appl. No. 12/299,411, 36 pages.
Office Action issued Feb. 25, 2011 for U.S. Appl. No. 11/936,411, 66 pages.
GE Oil & Gas; "Hydril Pressure Control K Pulsation Dampers," product information, dated Aug. 6, 2010, 2 pages.
Weatherford International Ltd.; "Weatherford Model 7800 Rotating Control Device", article No. 4593.00, dated 2007, 5 pages.
Weatherford International Ltd.; "Model 7875 Rotating Control Device", article No. 4594.01, dated 2010, 4 pages.
Hannegan, Don; Weatherford International; "Offshore Drilling Hazard Mitigation: Controlled Pressure Drilling Redefines What is Drillable", Managed Pressure Drilling Magazine, Drilling Contractor article, dated Jan.-Feb. 2009, 4 pages.
Smith Services; "Hold 2500 Rotating Control Device", product brochure, article No. ss-04-0055, dated 2004, 4 pages.
Smith Services; "Marine Riser RCD", product presentation, dated Jul. 2009, 18 pages.
Office Action issued Jan. 24, 2012 for U.S. Appl. No. 12/638,012, 18 pages.
Great Britain Examination Report issued Apr. 12, 2012 for GB Patent Application No. 1108380.5, 2 pages.
FAIPP Office Action issue Jul. 29, 2010 for U.S. Appl. No. 11/936,411, 3 pages.

* cited by examiner

EVENT SIGNATURES

| PARAMETERS | KICK | LOSS | CONNECTION STARTED | CONNECTION FINISHED |
|---|---|---|---|---|
| STANDPIPE PRESSURE | DECREASING | INCREASING | DECREASING | INCREASING |
| UPSTREAM CHOKE PRESSURE | DECREASING | INCREASING | DECREASING | INCREASING |
| DOWNSTREAM CHOKE PRESSURE | UNCHANGED | UNCHANGED | DECREASING | INCREASING |
| BELOW BOP PRESSURE | DECREASING | INCREASING | DECREASING | INCREASING |
| ANNULUS PRESSURE | DECREASING | INCREASING | DECREASING | INCREASING |
| BOTTOM HOLE PRESSURE | DECREASING | ERRATIC | DECREASING | INCREASING |
| SEPARATOR PRESSURE | UNCHANGED | UNCHANGED | UNCHANGED | UNCHANGED |
| BACKPRESSURE PUMP PRESSURE | DECREASING | INCREASING | INCREASING | DECREASING |
| UPSTREAM CHOKE TEMPERATURE | DECREASING | UNCHANGED | DECREASING | INCREASING |
| DOWNSTREAM CHOKE TEMPERATURE | DECREASING | UNCHANGED | DECREASING | INCREASING |
| BOTTOMHOLE TEMPERATURE | DECREASING | UNCHANGED | UNCHANGED | INCREASING |
| FLOW IN | UNCHANGED | UNCHANGED | DECREASING | INCREASING |
| FLOW OUT | INCREASING | DECREASING | DECREASING | INCREASING |
| BACKPRESSURE PUMP RATE | DECREASING | INCREASING | INCREASING | DECREASING |
| BIT DEPTH | N/A | N/A | ERRATIC | ERRATIC |
| RATE OF PENETRATION | N/A | N/A | DECREASING | INCREASING |
| HOOKLOAD | INCREASING | N/A | ERRATIC | ERRATIC |
| WEIGHT ON BIT | INCREASING | N/A | DECREASING | INCREASING |
| RPM | UNCHANGED | N/A | DECREASING | INCREASING |
| TORQUE | ERRATIC | N/A | DECREASING | INCREASING |
| CHOKE SIZE | INCREASING | DECREASING | DECREASING | INCREASING |
| PIT VOLUME | INCREASING | DECREASING | UNCHANGED | UNCHANGED |
| TRIP TANK | INCREASING | DECREASING | UNCHANGED | UNCHANGED |
| MUD WEIGHT IN | UNCHANGED | UNCHANGED | UNCHANGED | UNCHANGED |
| MUD WEIGHT OUT | DECREASING | UNCHANGED | UNCHANGED | UNCHANGED |
| FLOW OUT–FLOW IN | INCREASING | DECREASING | DECREASING | INCREASING |

FIG.5

WELL DRILLING METHODS WITH EVENT DETECTION

CROSS-REFERENCE TO RELATED APPLICATIONS

This application claims the benefit under 35 USC §119 of the filing date of International Application Serial No. PCT/US09/52227, filed Jul. 30, 2009. The entire disclosure of this prior application is incorporated herein by this reference.

BACKGROUND

The present disclosure relates generally to equipment utilized and operations performed in conjunction with a subterranean well and, in an embodiment described herein, more particularly provides well drilling methods with event detection.

It is desirable in drilling operations for certain events to be identified as soon as they occur, so that any needed remedial measures may be taken as soon as possible. Events can also be normal, expected events, in which case it would be desirable to be able to control the drilling operations based on identification of such events.

Therefore, it will be appreciated that improvements would be desirable in the art of detecting events occurring during drilling operations.

BRIEF DESCRIPTION OF THE DRAWINGS

FIG. 5 is a listing of events and corresponding event signatures which may be used in the method of FIG. 2.

DETAILED DESCRIPTION

Figure 1:
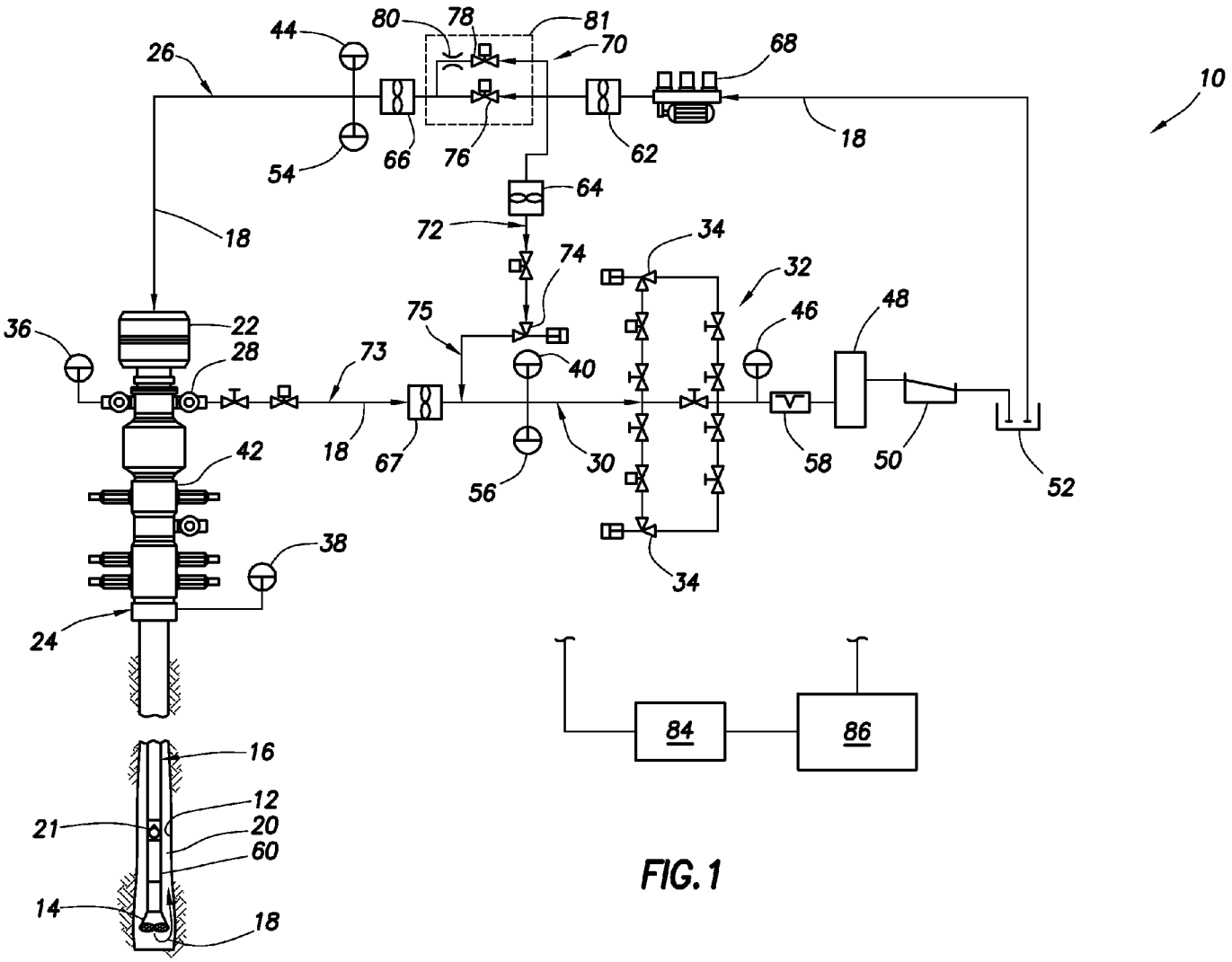
FIG. 1 is a schematic view of a well system which can embody principles of the present disclosure.

Representatively and schematically illustrated in FIG. 1 is a well drilling system 10 and associated method which can incorporate principles of the present disclosure. In the system 10, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (e.g., when connections are being made in the drill string).

Control of bottom hole pressure is very important in managed pressure drilling, and in other types of drilling operations. Preferably, the bottom hole pressure is accurately controlled to prevent excessive loss of fluid into the earth formation surrounding the wellbore 12, undesired fracturing of the formation, undesired influx of formation fluids into the wellbore, etc. In typical managed pressure drilling, it is desired to maintain the bottom hole pressure just greater than a pore pressure of the formation, without exceeding a fracture pressure of the formation. In typical underbalanced drilling, it is desired to maintain the bottom hole pressure somewhat less than the pore pressure, thereby obtaining a controlled influx of fluid from the formation.

Nitrogen or another gas, or another lighter weight fluid, may be added to the drilling fluid 18 for pressure control. This technique is useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through drilling fluid return lines 30, 73 to a choke manifold 32, which includes redundant chokes 34 (only one of which may be used at a time). Backpressure is applied to the annulus 20 by variably restricting flow of the fluid 18 through the operative choke(s) 34.

The greater the restriction to flow through the choke 34, the greater the backpressure applied to the annulus 20. Thus, bottom hole pressure can be conveniently regulated by varying the backpressure applied to the annulus 20. A hydraulics model can be used to determine a pressure applied to the annulus 20 at or near the surface which will result in a desired bottom hole pressure, so that an operator (or an automated control system) can readily determine how to regulate the pressure applied to the annulus at or near the surface (which can be conveniently measured) in order to obtain the desired bottom hole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the drilling fluid return lines 30, 73 upstream of the choke manifold 32.

Another pressure sensor 44 senses pressure in the drilling fluid injection (standpipe) line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 64, 66.

Not all of these sensors are necessary. For example, the system 10 could include only two of the three flowmeters 62, 64, 66. However, input from the sensors is useful to the hydraulics model in determining what the pressure applied to the annulus 20 should be during the drilling operation.

Furthermore, the drill string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD) systems. These drill string sensor systems generally provide at least pressure measurement, and may also provide temperature measurement, detection of drill string characteristics (such as vibration, torque, rpm, weight on bit, stick-slip, etc.), formation characteristics (such as resistivity, density, etc.), fluid characteristics and/or other measurements. Various forms of telemetry (acoustic, pressure pulse, electromagnetic, etc.) may be used to transmit the downhole sensor measurements to the surface.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc. Pressure and level sensors could be used with the separator 48, level sensors could be used to indicate a volume of drilling fluid in the mud pit 52, etc.

Fewer sensors could be included in the system 10, if desired. For example, the output of the rig mud pump 68 could be determined by counting pump strokes, instead of by using flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold 70 to the standpipe 26, the fluid then circulates downward through the drill string 16, upward through the annulus 20, through the drilling fluid return lines 30, 73, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the bottom hole pressure, unless the fluid 18 is flowing through the choke. In conventional overbalanced drilling operations, such a situation will arise whenever a connection is made in the drill string 16 (e.g., to add another length of drill pipe to the drill string as the wellbore 12 is drilled deeper), and the lack of circulation will require that bottom hole pressure be regulated solely by the density of the fluid 18.

In the system 10, however, flow of the fluid 18 through the choke 34 can be maintained, even though the fluid does not circulate through the drill string 16 and annulus 20, while a connection is being made in the drill string. Thus, pressure can still be applied to the annulus 20 by restricting flow of the fluid 18 through the choke 34, even though a separate backpressure pump may not be used.

Instead, the fluid 18 is flowed from the pump 68 to the choke manifold 32 via a bypass line 72, 75 when a connection is made in the drill string 16. Thus, the fluid 18 can bypass the standpipe line 26, drill string 16 and annulus 20, and can flow directly from the pump 68 to the mud return line 30, which remains in communication with the annulus 20. Restriction of this flow by the choke 34 will thereby cause pressure to be applied to the annulus 20.

As depicted in FIG. 1, both of the bypass line 75 and the mud return line 30 are in communication with the annulus 20 via a single line 73. However, the bypass line 75 and the mud return line 30 could instead be separately connected to the wellhead 24, for example, using an additional wing valve (e.g., below the RCD 22), in which case each of the lines 30, 75 would be directly in communication with the annulus 20. Although this might require some additional plumbing at the rig site, the effect on the annulus pressure would be essentially the same as connecting the bypass line 75 and the mud return line 30 to the common line 73. Thus, it should be appreciated that various different configurations of the components of the system 10 may be used, without departing from the principles of this disclosure.

Flow of the fluid 18 through the bypass line 72, 75 is regulated by a choke or other type of flow control device 74. Line 72 is upstream of the bypass flow control device 74, and line 75 is downstream of the bypass flow control device.

Flow of the fluid 18 through the standpipe line 26 is substantially controlled by a valve or other type of flow control device 76. Note that the flow control devices 74, 76 are independently controllable, which provides substantial benefits to the system 10, as described more fully below.

Since the rate of flow of the fluid 18 through each of the standpipe and bypass lines 26, 72 is useful in determining how bottom hole pressure is affected by these flows, the flowmeters 64, 66 are depicted in FIG. 1 as being interconnected in these lines. However, the rate of flow through the standpipe line 26 could be determined even if only the flowmeters 62, 64 were used, and the rate of flow through the bypass line 72 could be determined even if only the flowmeters 62, 66 were used. Thus, it should be understood that it is not necessary for the system 10 to include all of the sensors depicted in FIG. 1 and described herein, and the system could instead include additional sensors, different combinations and/or types of sensors, etc.

A bypass flow control device 78 and flow restrictor 80 may be used for filling the standpipe line 26 and drill string 16 after a connection is made, and equalizing pressure between the standpipe line and mud return lines 30, 73 prior to opening the flow control device 76.

Otherwise, sudden opening of the flow control device 76 prior to the standpipe line 26 and drill string 16 being filled and pressurized with the fluid 18 could cause an undesirable pressure transient in the annulus 20 (e.g., due to flow to the choke manifold 32 temporarily being lost while the standpipe line and drill string fill with fluid, etc.).

By opening the standpipe bypass flow control device 78 after a connection is made, the fluid 18 is permitted to fill the standpipe line 26 and drill string 16 while a substantial majority of the fluid continues to flow through the bypass line 72, thereby enabling continued controlled application of pressure to the annulus 20. After the pressure in the standpipe line 26 has equalized with the pressure in the mud return lines 30, 73 and bypass line 75, the flow control device 76 can be opened, and then the flow control device 74 can be closed to slowly divert a greater proportion of the fluid 18 from the bypass line 72 to the standpipe line 26.

Before a connection is made in the drill string 16, a similar process can be performed, except in reverse, to gradually divert flow of the fluid 18 from the standpipe line 26 to the bypass line 72 in preparation for adding more drill pipe to the drill string 16. That is, the flow control device 74 can be gradually opened to slowly divert a greater proportion of the fluid 18 from the standpipe line 26 to the bypass line 72, and then the flow control device 76 can be closed.

Note that the flow control device 78 and flow restrictor 80 could be integrated into a single element (e.g., a flow control device having a flow restriction therein), and the flow control devices 76, 78 could be integrated into a single flow control device 81 (e.g., a single choke which can gradually open to slowly fill and pressurize the standpipe line 26 and drill string 16 after a drill pipe connection is made, and then open fully to allow maximum flow while drilling).

However, since typical conventional drilling rigs are equipped with the flow control device 76 in the form of a valve in the standpipe manifold 70, and use of the standpipe valve is incorporated into usual drilling practices, the individually operable flow control devices 76, 78 are presently preferred. The flow control devices 76, 78 are at times referred to collectively below as though they are the single flow control device 81, but it should be understood that the flow control device 81 can include the individual flow control devices 76, 78.

Note that the system 10 could include a backpressure pump (not shown) for applying pressure to the annulus 20 and drilling fluid return line 30 upstream of the choke manifold 32, if desired. The backpressure pump could be used instead of, or in addition to, the bypass line 72 and flow control device 74 to ensure that fluid continues to flow through the choke manifold 32 during events such as making connections in the drill string 16. In that case, additional sensors may be used to, for example, monitor the pressure and flow rate output of the backpressure pump.

In other examples, connections may not be made in the drill string 16 during drilling, for example, if the drill string comprises a coiled tubing. The drill string 16 could be provided with conductors and/other lines (e.g., in a sidewall or interior of the drill string) for transmitting data, commands, pressure, etc. between downhole and the surface (e.g., for communication with the sensors 60).

Figure 2:
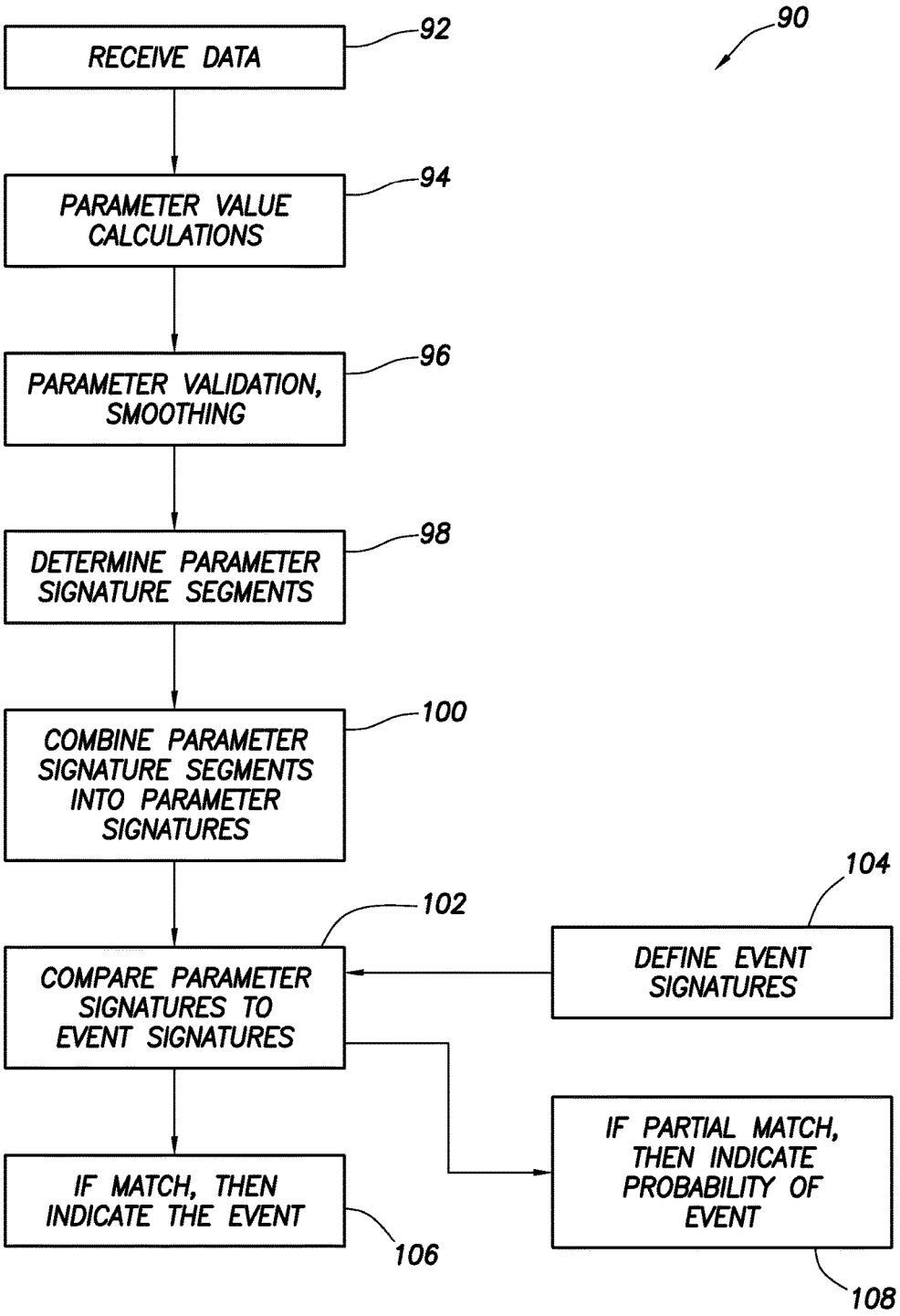
FIG. 2 is a flowchart representing a method which embodies principles of this disclosure.

Referring additionally now to FIG. 2, a well drilling method 90 which may be used with the system 10 of FIG. 1 is schematically illustrated. However, it should be clearly understood that the method 90 could be used in conjunction with other systems in keeping with the principles of this disclosure.

The method 90 includes an event detection process which can be used to alert an operator if an event occurs, such as, by triggering an alarm or displaying a warning if the event is an undesired event (e.g., unacceptable fluid loss to the formation, unacceptable fluid influx from the formation into the wellbore, etc.), or by displaying information about the event if it is a normal, expected or desired event, etc. In addition, an event can be a precursor to another event happening, in which case detection of the first event can be used as an indication that the second event is about to happen or is in process of occurring.

In addition, a series of events can also provide an indication that another event is about to happen. Thus, one or more prior events can be used as a source of data for determining if another event will occur.

Many different events and types of events can be detected in the method 90. These events can include, but are not limited to, a kick (influx), partial fluid loss, total fluid loss, standpipe bleed down, plugged choke, washed out choke, poor hole cleaning (wellbore packed off about drill string), downhole crossflow, wellbore washout, under gauged wellbore, drilling break, ballooning while circulating, ballooning while mud pump is off, stuck pipe, twisted off pipe, back off, plugging of bit nozzle, bit nozzle washed out, leak in surface processing equipment, rig pump failure, backpressure pump failure, downhole sensor 60 failure, washed out drill string, non-return valve failure, start of drill pipe connection, drill pipe connection finished, etc.

In order to detect the events, drilling parameter "signatures" produced in real time are compared to a set of event "signatures" in order to determine if any of the events represented by those event signatures is occurring. Thus, what is happening now in the drilling operation (the drilling parameter signatures) is compared to a set of signatures which correspond to drilling events and, if there is a match, this is an indication that the event corresponding to the matched event signature is occurring.

Drilling properties (e.g., pressure temperature, flow rate, etc.) are sensed by sensors, and output from the sensors is used to supply data indicative of the drilling properties. This drilling property data is used to determine drilling parameters of interest.

Data can also be in the form of data from offset wells (e.g., other wells drilled nearby or in similar lithologies, conditions, etc.). Previous experience of drillers can also serve as a source for the data. Data can also be entered by an operator prior to or during the drilling operation.

A drilling parameter can comprise data related to a single drilling property, or a parameter can comprise a ratio, product, difference, sum or other function of data related to multiple drilling properties. For example, it is useful in drilling operations to monitor the difference between the flow rate of drilling fluid injected into the well (e.g., via the standpipe line 26 as sensed by flowmeter 66) and the flow rate of drilling fluid returned from the well (e.g., via the drilling fluid return line 30 as sensed by the flowmeter 67). Thus, a parameter of interest, which can be used to define a part or segment of a signature can be this difference in drilling properties (flow rate in−flow rate out).

During a drilling operation, the drilling properties are sensed over time, either continuously or intermittently. Thus, data related to the drilling properties is available over time, and the behavior of each drilling parameter can be evaluated in real time. Of particular interest in the method 90 is how the drilling parameters change over time, that is, whether each parameter is increasing, decreasing, remaining substantially the same, remaining within a certain range, exceeding a maximum, falling below a minimum, etc.

These parameter behaviors are given appropriate values, and the values are combined to generate parameter signatures indicative of what is occurring in real time during the drilling operation. For example, one segment of a parameter signature could indicate that standpipe pressure (e.g., as measured by sensor 44) is increasing, and another segment of the parameter signature could indicate that pressure upstream of the choke manifold (e.g., as measured by sensor 40) is decreasing.

A parameter signature can include many (perhaps 20 or more) of these segments. Thus, a parameter signature can provide a "snapshot" of what is happening in real time during the drilling operation.

An event signature, on the other hand, does not represent what is occurring in real time during a drilling operation. Instead, an event signature is representative of what the drilling parameter behaviors will be when the corresponding event does happen. Each event signature is unique, because each event is indicated by a unique combination of parameter behaviors.

As discussed above, an event can be a precursor to another event. In that case, the event signature for the first event can be a unique combination of parameter behaviors which indicate that the second event is about to (or at least is eventually going to) happen.

Events can be parameters, for example, in the circumstance discussed above in which a series of events can indicate that another event is going to happen. In that case, the corresponding parameter behavior can be whether or not the precursor event(s) have happened.

Event signatures can be generated prior to commencing a drilling operation, and can be based on experience gained from drilling similar wells under similar conditions, etc. Event signatures can also be refined as a drilling operation progresses and more experience is gained on the well being drilled.

In basic terms, sensors are used to sense drilling properties during a drilling operation, data relating to the sensed properties are used to determine drilling parameters of interest, values indicative of the behaviors of these parameters are combined to form parameter signatures, and the parameter signatures are compared to pre-defined event signatures to detect whether any of the corresponding events is occurring.

Steps in the event detection process are schematically represented in FIG. 2 in flowchart form. However, it should be understood that the method 90 can include additional, alternative or optional steps as well, and it is not necessary for all of the depicted steps to be performed in keeping with the principles of this disclosure.

In a first step 92 depicted in FIG. 2, data is received. The data in this example is received from a central database, such as an INSITE™ database utilized by Halliburton Energy Services, Inc. of Houston, Tex. USA, although other databases may be used if desired.

The data typically is in the form of measurements of drilling properties as sensed by various sensors during a drilling operation. For example, the sensors 36, 38, 40, 44, 46, 54, 56, 58, 60, 62, 64, 66, 67, as well as other sensors, will produce indications of various properties (such as pressure, temperature, mass or volumetric flow rate, density, resistivity, rpm, torque, weight, position, etc.), which will be stored as data in the database. Calibration, conversion and/or other operations may be performed for the data prior to the data being received from the database.

The data may also be entered manually by an operator. As another alternative, data can be received directly from one or more sensors, or from another data acquisition system, whether or not the data originates from sensor measurements, and without first being stored in a separate database. Furthermore, as discussed above, the data can be derived from an offset well, previous experience, etc. Any source for the data may be used, in keeping with the principles of this disclosure.

In step 94, various parameter values are calculated for later use in the method 90. For example, it may be desirable to calculate a ratio of data values, a sum of data values, a difference between data values, a product of data values, etc. In some instances, however, the value of the data itself is used as is, without any further calculation.

In step 96, the parameter values are validated and smoothing techniques may be used to ensure that meaningful parameter values are utilized in the later steps of the method 90. For example, a parameter value may be excluded if it represents an unreasonably high or low value for that parameter, and the smoothing techniques may be used to prevent unacceptably large parameter value transitions from distorting later analysis. A parameter value can correspond to whether or not another event has occurred, as discussed above.

In step 98, the parameter signature segments are determined. This step can include calculating values indicative of the behaviors of the parameters. For example, if a parameter has an increasing trend, a value of 1 may be assigned to the corresponding parameter signature segment, if a parameter has a decreasing trend, a value of 2 may be assigned to the segment, if the parameter is unchanged, a value of 0 may be assigned to the segment, etc. To determine the behavior of a parameter, statistical calculations (algorithms) may be applied to the parameter values resulting from step 96.

Comparisons between parameters may also be made to determine a particular signature segment. For example, if one parameter is greater than another parameter, a value of 1 may be assigned to the signature segment, if the first parameter is less than the second parameter, a value of 2 may be assigned, if the parameters are substantially equal, a value of 0 may be assigned, etc.

In step 100, the parameter signature segments are combined to make up the parameter signatures. Each parameter signature is a combination of parameter signature segments and represents what is happening in real time in the drilling operation.

In step 102, the parameter signatures are compared to the previously defined event signatures to see if there is a match. Since data is continuously (or at least intermittently) being generated in real time during a drilling operation, corresponding parameter signatures can also be generated in the method 90 in real time for comparison to the event signatures. Thus, an operator can be informed immediately during the drilling operation whether an event is occurring.

Step 104 represents defining of the event signatures which, as described above, can be performed prior to and/or during the drilling operation. Example event signatures are provided in FIG. 5, and are discussed in further detail below.

In step 106, an event is indicated if there is a match between an event signature and a parameter signature. An indication can be provided to an operator, for example, by displaying on a computer screen information relating to the event, displaying an alert, sounding an alarm, etc. Indications can also take the form of recording the occurrence of the event in a database, computer memory, etc. A control system can also, or alternatively, respond to an indication of an event, as described more fully below.

In step 108, a probability of an event occurring is indicated if there is a partial match between an event signature and a parameter signature. For example, if an event signature comprises a combination of 30 parameter behaviors, and a parameter signature is generated in which 28 or 29 of the parameter behaviors match those of the event signature, there may be a high probability that the event is occurring, even though there may not be a complete match between the parameter signature and the event signature. It could be useful to provide an indication to an operator in this circumstance that the probability that the event is occurring is high.

Another useful indication would be of the probability of the event occurring in the future. For example if, as in the example discussed above, 28 or 29 of the 30 parameter behaviors match between the parameter signature and the event signature, and the unmatched parameter behaviors are trending toward matching, then it would be useful (particularly if the event is an undesired event) to warn an operator that the event is likely to occur, so that remedial measures may be taken if needed (for example, to prevent an undesired event from occurring).

Figure 3:
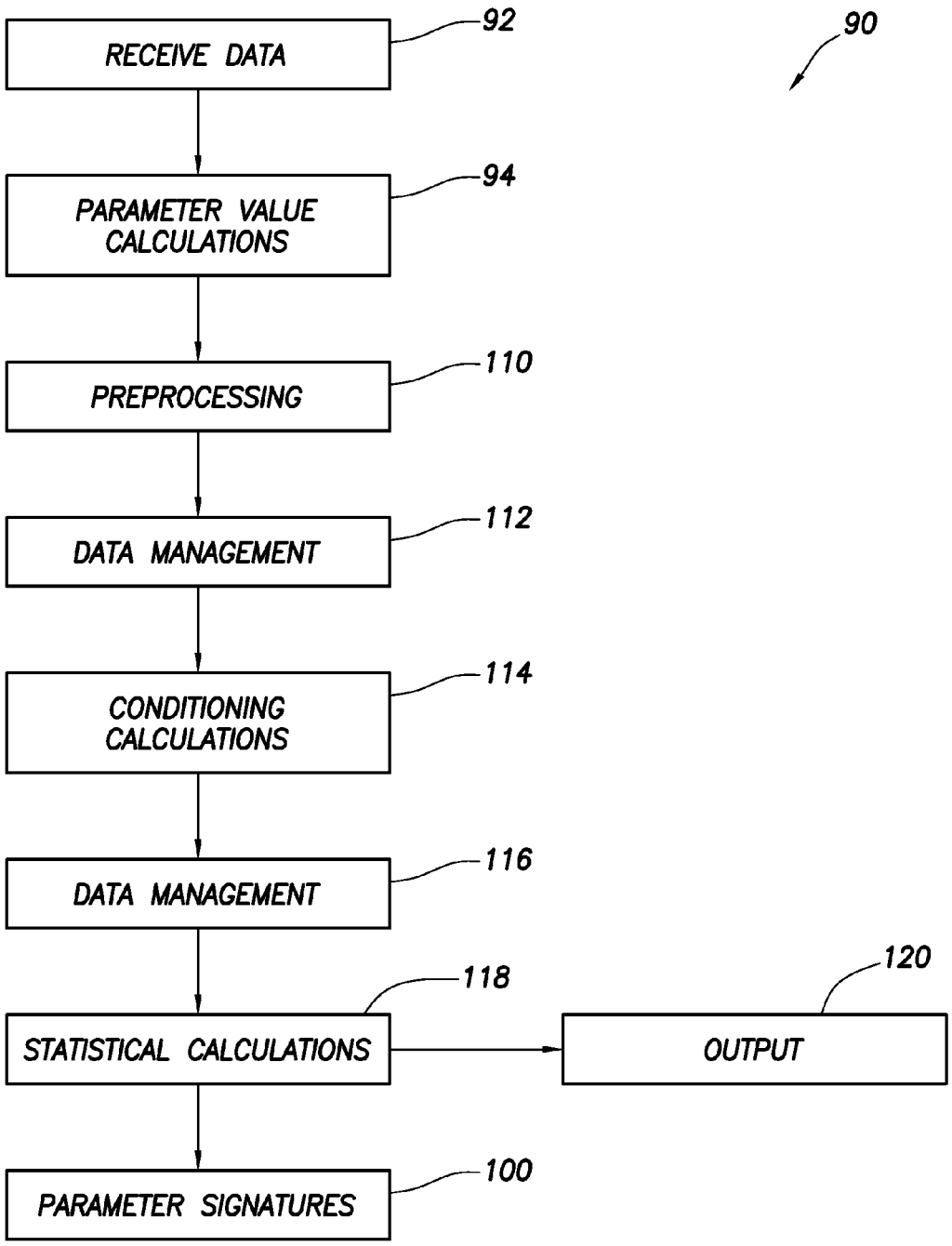
FIG. 3 is a flowchart of an example of a parameter signature generation process which may be used in the method of FIG. 2.

Referring additionally now to FIG. 3, a flowchart of another example of the process of generating the parameter signatures in the method 90 is representatively illustrated. The process begins with receiving the data as in step 92 described above. Parameter value calculations are then performed as in step 94 described above.

In step 110, preprocessing operations are performed for the parameter values. For example, maximum and minimum limits may be used for particular parameters, in order to exclude erroneously high or low values of the parameters.

In step 112, the preprocessed parameter values are stored in a data buffer. The data buffer is used to queue up the parameter values for subsequent processing.

In step 114, conditioning calculations are performed for the parameter values. For example, smoothing may be used (such as, moving window average, Savitzky-Golay smoothing, etc.) as discussed above in relation to step 96.

In step 116, the conditioned parameter values are stored in a data buffer.

In step 118, statistical calculations are performed for the parameter values. For example, trend analysis (such as, straight line fit, determination of trend direction over time, first and second order derivatives, etc.) may be used to characterize the behavior of a parameter. Values assigned to the parameter behaviors become segments of the resulting parameter signatures, as discussed above for step 98.

In step 120, the parameter signature segments are output to the database for storage, subsequent analysis, etc. In this example, the parameter signature segments become part of the INSITE™ database for the drilling operation.

In step 100, as discussed above, the parameter signature segments are combined to form the parameter signatures.

Figure 4:
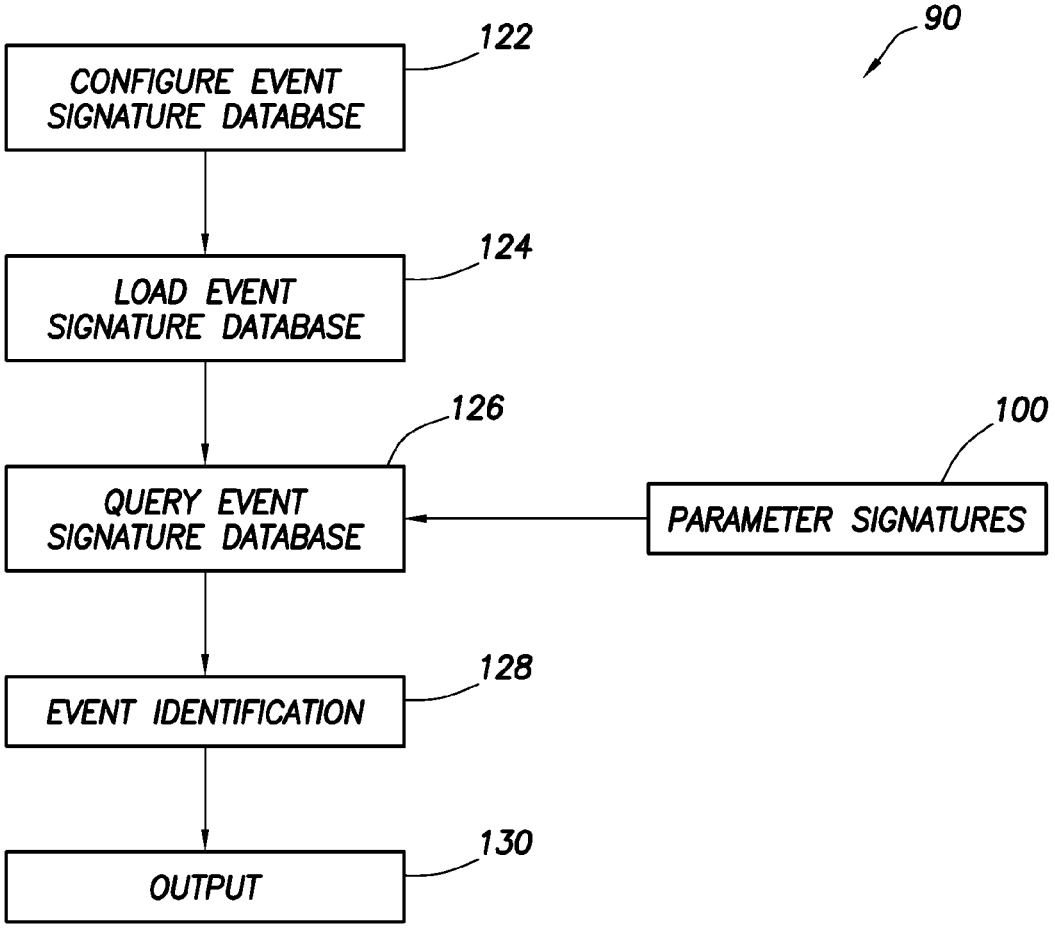
FIG. 4 is a flowchart of an example of an event signature generation and event identification process which may be used in the method of FIG. 2.

Referring additionally now to FIG. 4, a flowchart of another example of the process of generating the event signatures in the method 90 is representatively illustrated. The process begins with step 122, in which an event signature database is configured. The database can be configured to include any number of event signatures to enable any number of corresponding events to be identified during a drilling operation. Preferably, the event signature database can be separately configured for different types of drilling operations, such as underbalanced drilling, overbalanced drilling, drilling in particular lithologies, etc.

In step 124, a desired set of event signatures are loaded into the event signature database. As discussed above, any number, type and/or combination of event signatures may be used in the method 90.

In step 126, the event signature database is queried to see if there are any matches to the parameter signatures generated in step 100. As discussed above, partial matches may optionally be identified, as well.

In step 128, events are identified which correspond to event signatures which match (or at least partially match) any parameter signatures. The output in step 130 can take various different forms, which may depend upon the identified event. An alarm, alert, warning, display of information, etc. may be provided as discussed above for step 106. At a minimum, occurrence of the event should be recorded, and in this example preferably is recorded, as part of the INSITE™ database for the drilling operation.

Referring additionally now to FIG. 5, four example event signatures are representatively tabulated, along with parameter behaviors which correspond to the segments of the signatures. In practice, many more event signatures may be provided, and more or less parameter behaviors may be used for determining the signature segments.

Note that each event signature is unique. Thus, a kick (influx) event is indicated by a particular combination of parameter behaviors, whereas a fluid loss event is indicated by another particular combination of parameter behaviors.

If, during a drilling operation, a parameter signature is generated which matches (or at least partially matches) any of the event signatures shown in FIG. 5, an indication will be provided that the corresponding event is occurring. This can happen even without any human intervention, resulting in a more automated, precise and safe drilling environment.

The event indications provided by the method 90 can also be used to control the drilling operation. For example, if a kick event is indicated, the operative choke(s) 34 can be adjusted in response to increase pressure applied to the annulus 20 in the system 10. If fluid loss is detected, the choke(s) 34 can be adjusted to decrease pressure applied to the annulus 20. If a drill pipe connection is starting, the flow control devices 81, 74 can be appropriately adjusted to maintain a desired pressure in the annulus 20 during the connection process, and when completion of the drill pipe connection is detected, the flow control devices can be appropriately adjusted to restore circulation flow through the drill string 16 in preparation for drilling ahead.

These and other types of control over the drilling operation can be implemented based on detection of the corresponding events using the method 90 automatically and without human intervention, if desired. In one example, a control system such as that described in international application serial no. PCT/US08/87686 may be used for implementing such control over the drilling operation.

As depicted in FIG. 1, a controller 84 (such as a programmable logic controller or another type of controller capable of controlling operation of drilling equipment) is connected to a control system 86 (such as the control system described in international application serial no. PCT/US08/87686). The controller 84 is also connected to the flow control devices 34, 74, 81 for regulating flow injected into the drill string 16, flow through the drilling fluid return line 30, and flow between the standpipe injection line 26 and the return line 30.

The control system 86 can include various elements, such as one or more computing devices/processors, a hydraulic model, a wellbore model, a database, software in various formats, memory, machine-readable code, etc. These elements and others may be included in a single structure or location, or they may be distributed among multiple structures or locations.

The control system 86 is connected to the sensors 36, 38, 40, 44, 46, 54, 56, 58, 60, 62, 64, 66, 67 which sense respective drilling properties during the drilling operation. As discussed above, offset well data, previous operator experience, other operator input, etc. may also be input to the control system 86. The control system 86 can include software, programmable and preprogrammed memory, machine-readable code, etc. for carrying out the steps of the method 90 described above.

The control system 86 may be located at the wellsite, in which case the sensors 36, 38, 40, 44, 46, 54, 56, 58, 60, 62, 64, 66, 67 could be connected to the control system by wires or wirelessly. Alternatively, the control system 86 could be located at a remote location, in which case the control system could receive data via satellite transmission, the Internet, wirelessly, or by any other appropriate means. The controller 84 can also be connected to the control system 86 in various ways, whether the control system is locally or remotely located.

It may now be fully appreciated that the above disclosure provides many benefits to the art of well drilling and event detection during drilling operations. The methods described above enable drilling events to be detected accurately and in real time, so that appropriate actions may be taken if needed.

In particular, the above disclosure provides to the art a well drilling method 90 which includes the steps of: assigning a value to a behavior of each of multiple drilling parameters during a drilling operation; forming multiple parameter signatures, each of the parameter signatures comprising a respective combination of the values; comparing the parameter signatures to multiple event signatures, each of the event signatures being indicative of a respective drilling event; and controlling the drilling operation in response to at least a partial match resulting from comparing the parameter signatures to the event signatures.

Controlling the drilling operation may be performed in response to a complete match resulting from comparing the parameter signatures to the event signatures.

The method 90 may include drilling a wellbore 12, and the drilling operation is preferably performed in furtherance of drilling the wellbore 12.

The method 90 may include alerting an operator in response to at least the partial match resulting from comparing the parameter signatures to the event signatures.

At least one of the behaviors may comprise an increasing trend. At least one of the behaviors may comprise a trend increasing at greater than a predetermined rate.

At least one of the behaviors may comprise a decreasing trend. At least one of the behaviors may comprise a trend decreasing at greater than a predetermined rate.

Controlling the drilling operation may include controlling flow through a drilling fluid return line 30. Controlling the drilling operation may include controlling flow through a drilling fluid injection line 26.

The drilling parameters may be derived at least in part from drilling properties sensed by sensors during the drilling operation, from offset well data, from operator input, from whether at least one precursor event has occurred, and/or from whether multiple precursor events have occurred.

The method 90 may include, in response to the at least partial match resulting from comparing the parameter signatures to the event signatures, indicating that an event will occur.

Further provided by the above disclosure is a well system 10 which includes a control system 86 including machine-readable code and a processor which a) assigns a value to a behavior of each of multiple drilling parameters during the drilling operation, b) forms multiple parameter signatures, each of the parameter signatures comprising a respective combination of the values, and c) compares the parameter signatures to multiple event signatures, each of the event signatures being indicative of a respective drilling event. The well system 10 also comprises a controller 84 which controls the drilling operation in response to at least a partial match resulting from comparing the parameter signatures to the event signatures.

The controller 84 may control the drilling operation in response to a complete match resulting from comparing the parameter signatures to the event signatures.

The drilling operation may comprise drilling the wellbore 12.

The control system 86 may alert an operator in response to at least the partial match resulting from comparing the parameter signatures to the event signatures.

At least one of the behaviors may comprise an increasing trend, a trend increasing at greater than a predetermined rate, a decreasing trend, or a trend decreasing at greater than a predetermined rate.

The controller 84 may control the drilling operation at least in part by controlling flow through a drilling fluid return line 30, by controlling flow through a drilling fluid injection line 26 and/or by controlling flow between the return and injection lines.

The drilling parameters may be derived at least in part from drilling properties sensed by sensors during the drilling operation, from offset well data, from operator input, from whether at least one precursor event has occurred, and/or from whether multiple precursor events have occurred.

The control system 86 may, in response to the at least partial match resulting from comparing the parameter signatures to the event signatures, indicate that an event will occur.

Also described in the above disclosure is a well drilling method 90 which includes: defining an event signature comprising a unique combination of a behavior of each of multiple drilling parameters, the event signature being indicative of a drilling event; accessing data from each of multiple sensors 36, 38, 40, 44, 46, 54, 56, 58, 60, 62, 64, 66, 67 which sense respective drilling properties during a drilling operation; determining multiple parameter signature segments from the respective sensed drilling properties; combining the parameter signature segments, thereby forming a parameter signature; and comparing the parameter signature to the event signature.

The method 90 may include indicating the event when the parameter signature matches the event signature. The method 90 may include indicating a probability of the event when the parameter signature partially matches the event signature.

Determining the multiple signature segments may include determining a trend of at least one of the sensed drilling parameters, determining a ratio of selected ones of the sensed drilling parameters, determining a difference between selected ones of the sensed drilling parameters, determining whether at least one of the sensed drilling parameters is within a predetermined range, determining whether at least one of the sensed drilling parameters is greater than a predetermined value, and/or determining whether at least one of the sensed drilling parameters is less than a predetermined value.

The event may comprise an undesired abnormal event. The event could alternatively comprise a normal expected event.

The method 90 may include controlling the drilling operation in response to comparing the parameter signature to the event signature. Controlling the drilling operation may include controlling flow through a drilling fluid return line 30, through a drilling fluid injection line 26 and/or from a drilling fluid injection line 26 to a drilling fluid return line 30.

Accessing data may include inputting offset well data indicative of respective drilling properties, inputting operator experience indicative of respective drilling properties, and/or accessing whether at least one prior event has occurred.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well drilling method, comprising:

assigning a value to a behavior of each of multiple drilling parameters during a drilling operation, wherein the drilling parameters are derived at least in part from whether at least one precursor event has occurred;

forming multiple parameter signatures, each of the parameter signatures comprising a respective combination of the values;

comparing the parameter signatures to multiple event signatures, each of the event signatures being indicative of a respective drilling event; and controlling the drilling operation in response to a partial match resulting from comparing the parameter signatures to the event signatures.

2. The method of claim 1, further comprising drilling a wellbore, and wherein the drilling operation is performed in furtherance of drilling the wellbore.

3. The method of claim 1, further comprising alerting an operator in response to the partial match resulting from comparing the parameter signatures to the event signatures.

4. The method of claim 1, wherein at least one of the behaviors comprises an increasing trend.

5. The method of claim 1, wherein at least one of the behaviors comprises a trend increasing at greater than a predetermined rate.

6. The method of claim 1, wherein at least one of the behaviors comprises a decreasing trend.

7. The method of claim 1, wherein at least one of the behaviors comprises a trend decreasing at greater than a predetermined rate.

8. The method of claim 1, wherein controlling the drilling operation further comprises controlling flow through a drilling fluid return line.

9. The method of claim 1, wherein controlling the drilling operation further comprises controlling flow through a drilling fluid injection line.

10. The method of claim 1, wherein the drilling parameters are derived at least in part from drilling properties sensed by sensors during the drilling operation.

11. The method of claim 1, wherein the drilling parameters are derived at least in part from offset well data.

12. The method of claim 1, wherein the drilling parameters are derived at least in part from operator input.

13. The method of claim 1, wherein the drilling parameters are derived at least in part from whether multiple precursor events have occurred.

14. The method of claim 1, further comprising, in response to the partial match resulting from comparing the parameter signatures to the event signatures, indicating that an event will occur.

15. A well system, comprising:

a control system including machine-readable code and a processor which a) assigns a value to a behavior of each of multiple drilling parameters during the drilling operation, b) forms multiple parameter signatures, each of the parameter signatures comprising a respective combination of the values, and c) compares the parameter signatures to multiple event signatures, each of the event signatures being indicative of a respective drilling event, wherein the drilling parameters are derived at least in part from whether at least one precursor event has occurred; and a controller which controls the drilling operation in response to a partial match resulting from comparing the parameter signatures to the event signatures.

16. The system of claim 15, wherein the drilling operation comprises drilling the wellbore.

17. The system of claim 15, wherein the control system alerts an operator in response to the partial match resulting from comparing the parameter signatures to the event signatures.

18. The system of claim 15, wherein at least one of the behaviors comprises an increasing trend.

19. The system of claim 15, wherein at least one of the behaviors comprises a trend increasing at greater than a predetermined rate.

20. The system of claim 15, wherein at least one of the behaviors comprises a decreasing trend.

21. The system of claim 15, wherein at least one of the behaviors comprises a trend decreasing at greater than a predetermined rate.

22. The system of claim 15, wherein the controller controls the drilling operation at least in part by controlling flow through a drilling fluid return line.

23. The system of claim 15, wherein the controller controls the drilling operation at least in part by controlling flow through a drilling fluid injection line.

24. The system of claim 15, wherein the drilling parameters are derived at least in part from drilling properties sensed by sensors during the drilling operation.

25. The system of claim 15, wherein the drilling parameters are derived at least in part from offset well data.

26. The system of claim 15, wherein the drilling parameters are derived at least in part from operator input.

27. The system of claim 15, wherein the drilling parameters are derived at least in part from whether multiple precursor events have occurred.

28. The system of claim 15, wherein the control system, in response to the partial match resulting from comparing the parameter signatures to the event signatures, indicates that an event will occur.

29. A well drilling method, comprising:

defining an event signature comprising a unique combination of a behavior of each of multiple drilling parameters, the event signature being indicative of a drilling event;

accessing data from each of multiple sensors which sense respective drilling properties during a drilling operation;

determining multiple parameter signature segments from the respective drilling properties;

combining the parameter signature segments, thereby forming a parameter signature;

comparing the parameter signature to the event signature;

controlling the drilling operation in response to a partial match resulting from comparing the parameter signature to the event signature; and indicating a probability of the event when the parameter signature partially matches the event signature.

30. The method of claim 29, further comprising indicating the event when the parameter signature partially matches the event signature.

31. The method of claim 30, wherein indicating the event further comprises indicating that a future event will occur.

32. The method of claim 29, wherein determining the multiple signature segments further comprises determining a trend of at least one of the drilling parameters.

33. The method of claim 29, wherein determining the multiple signature segments further comprises determining a ratio of selected ones of the drilling parameters.

34. The method of claim 29, wherein determining the multiple signature segments further comprises determining a difference between selected ones of the drilling parameters.

35. The method of claim 29, wherein determining the multiple signature segments further comprises determining whether at least one of the drilling parameters is within a predetermined range.

36. The method of claim 29, wherein determining the multiple signature segments further comprises determining whether at least one of the drilling parameters is greater than a predetermined value.

37. The method of claim 29, wherein determining the multiple signature segments further comprises determining whether at least one of the drilling parameters is less than a predetermined value.

38. The method of claim 29, wherein the event comprises an undesired abnormal event.

39. The method of claim 29, wherein controlling the drilling operation further comprises controlling flow through a drilling fluid return line.

40. The method of claim 29, wherein controlling the drilling operation further comprises controlling flow through a drilling fluid injection line.

41. The method of claim 29, wherein controlling the drilling operation further comprises controlling flow from a drilling fluid injection line to a drilling fluid return line.

42. The method of claim 29, wherein accessing data further comprises inputting offset well data indicative of respective drilling properties.

43. The method of claim 29, wherein accessing data further comprises inputting operator experience indicative of respective drilling properties.

44. The method of claim 29, wherein accessing data further comprises accessing whether at least one prior event has occurred.

* * * * *